US007530320B1

(12) United States Patent
Portmann

(10) Patent No.: US 7,530,320 B1
(45) Date of Patent: May 12, 2009

(54) UNDERWATER WATER CANNON DEFENSE SYSTEM

(75) Inventor: Helmut Portmann, Panama City Beach, FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 62 days.

(21) Appl. No.: 11/894,631

(22) Filed: Jul. 16, 2007

(51) Int. Cl.
*B63G 8/28* (2006.01)

(52) U.S. Cl. ..... 114/319; 440/39; 440/40

(58) Field of Classification Search ..... 15/1.7; 114/312, 319; 239/11, 172; 440/39, 40
See application file for complete search history.

(56) References Cited

U.S. PATENT DOCUMENTS

| | | | | | |
|---|---|---|---|---|---|
| 3,155,319 | A | * | 11/1964 | Hammelmann | 239/172 |
| 3,586,236 | A | * | 6/1971 | Schaffler | 239/172 |
| 3,823,847 | A | * | 7/1974 | Ware | 222/79 |
| 4,058,256 | A | * | 11/1977 | Hobson et al. | 239/172 |
| 4,100,641 | A | * | 7/1978 | Pansini | 15/1.7 |
| 5,295,890 | A | * | 3/1994 | Myers | 446/176 |
| 5,299,960 | A | * | 4/1994 | Day et al. | 440/39 |

* cited by examiner

*Primary Examiner*—Lars A Olson
(74) *Attorney, Agent, or Firm*—James T. Shepherd

(57) ABSTRACT

An underwater water cannon defense system includes an underwater vehicle, a water cannon coupled to the vehicle, one or more nozzles mounted on the vehicle and directed away therefrom, and water distribution valving mounted in the vehicle that distributes pressurized water to the water cannon and the one or more nozzles in a controlled fashion.

17 Claims, 2 Drawing Sheets

UNDERWATER WATER CANNON DEFENSE SYSTEM

ORIGIN OF THE INVENTION

The invention described herein was made in the performance of official duties by an employee of the Department of the Navy and may be manufactured, used, licensed by or for the Government for any governmental purpose without payment of any royalties thereon.

FIELD OF THE INVENTION

The invention relates generally to underwater defense systems, and more particularly to an underwater defense system that uses a water cannon.

BACKGROUND OF THE INVENTION

There is a heightened concern over underwater attacks on ships in port and the port facilities. Some of the underwater threats of greatest concern are presented by swimmers/divers or small unmanned systems that can enter a port's waters undetected relatively easily. Currently, a variety of sensor, physical barrier, and response systems are available to prevent such underwater invasions. Although effective systems have been demonstrated, they are not suitable for widespread civilian and commercial in-port use due to safety and/or environmental issues, or they are cost prohibitive to deploy in large numbers.

SUMMARY OF THE INVENTION

Accordingly, it is an object of the present invention to provide an underwater defense system that can be effective against relatively small underwater threats.

Another object of the present invention is to provide an underwater defense system that satisfies safety and/or environmental issues in an in-port environment.

Other objects and advantages of the present invention will become more obvious hereinafter in the specification and drawings.

In accordance with the present invention, an underwater water cannon defense system uses a vehicle adapted to be placed underwater. A water cannon is coupled to the vehicle. At least one nozzle is mounted on the vehicle and is directed away therefrom. Water distribution valving mounted in the vehicle is adapted to receive a supply of pressurized water and then distribute the pressurized water to the water cannon and the one or more nozzles in a controlled fashion. Movement of the vehicle underwater is governed by the amounts of pressurized water distributed to the one or more nozzles.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
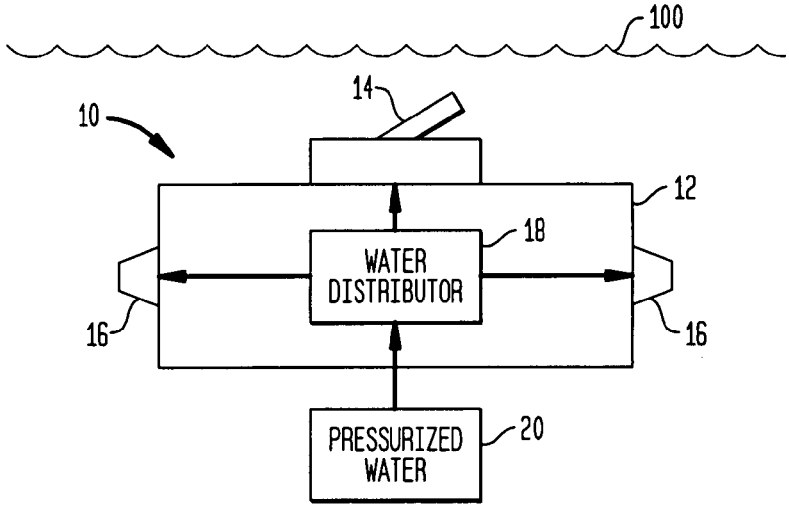
FIG. 1 is a top-level block diagram of an underwater water cannon defense system in accordance with the present invention.

Referring now to the drawings and more particularly to FIG. 1, a top-level block diagram of an underwater water cannon defense system in accordance with the present invention is shown and is referenced generally by numeral 10. In general, water cannon defense system 10 is designed to be placed and operated in an underwater environment, i.e., beneath the water's surface referenced by numeral 100. Depending on its design sophistication, defense system 10 can be a completely self-contained autonomous system or can be tethered and controlled from an above-the-surface location (e.g., onboard a ship, on land, etc.) without departing from the scope of the present invention.

Regardless of its particular control features, each embodiment of system 10 includes a vehicle 12 that can operate on or under the water's surface 100, a water cannon 14 mounted on vehicle 12, one or more nozzles 16 (e.g., two are illustrated) mounted on vehicle 12 with each of nozzles 16 being directed substantially away from vehicle 12, and a water distributor 18 mounted on or in vehicle 12 for distributing a supply of pressurized water 20 in a controlled way to water cannon 14 and nozzles 16. The supply of pressurized water 20 could be generated onboard vehicle 12 (e.g., by a pump on vehicle 12 that draws in water from the surrounding environment and pressurizes same). Pressurized water 20 could also originate from an external source located under or above water's surface 100 with delivery of pressurized water 20 to water distributor 18 being handled by a hose or other conduit. Since conventional fire fighting hose connections are available at most ports or similar facilities, the hoses and various coupling fixtures used in embodiments of the present invention can be conventional fire fighting hoses/couplings.

Water distributor 18 controls the distribution of pressurized water 20 to control the movement/position of vehicle 12 and the firing of water cannon 14. In terms of moving/positioning vehicle 12, some portion of pressurized water 20 is directed towards nozzles 16. For example, to move the illustrated vehicle 12 to the right, the left one of nozzles 16 receives more of pressurized water 20 than the right one of nozzles 16 to thereby generate thrust that moves vehicle 12 to the right. To subsequently slow or stop vehicle 12, additional amounts of pressurized water 20 can be directed to the right one of nozzles 16. While vehicle 12 is moving and/or when it has been positioned, water distributor 18 can also provide a portion of pressurized water 20 to water cannon 14 for firing therefrom. The water fired from water cannon 14 can be directed towards an underwater target or a target on the water's surface 100. The water fired from water cannon 14 could also serve as a protective underwater barrier that makes it difficult for an underwater swimmer/diver/vehicle to traverse. Accordingly, a plurality of defense systems 10 could be used to project a "wall" of pressurized water with the "wall" being stationary or moving.

Water cannon 14 could be rigidly mounted to vehicle 12 such that the aim point of water cannon 14 was fixed relative to the orientation of vehicle 12. In this case, the aim point of water cannon 14 could only be adjusted by adjusting the position of vehicle 12. However, water cannon 14 could also be movably mounted to vehicle 12 so that the aim point of water cannon 14 could be adjusted relative to, and independent of, vehicle 12.

In the illustrated example, nozzles 16 are aimed in opposing directions to provide for left/right movement of vehicle 12. However, additional nozzles could be used to control movement of vehicle 12 in other directions as would be the case if vehicle 12 was a freely-swimming vehicle.

Each of nozzles 16 can be fixed or movable in their orientation relative to vehicle 12. The particular shape, size and/or configuration of nozzles 16 are not limitations of the present invention. Similarly, the configuration of water distributor 18 can be realized in a variety of ways without departing from the scope of the present invention. For example, water distributor 18 could be realized by a single, multi-way valve or by a series of valves controlled by a controller (not shown) receiving control signals from an onboard or remotely-located vehicle control and targeting system (not shown in FIG. 1).

Figure 2:
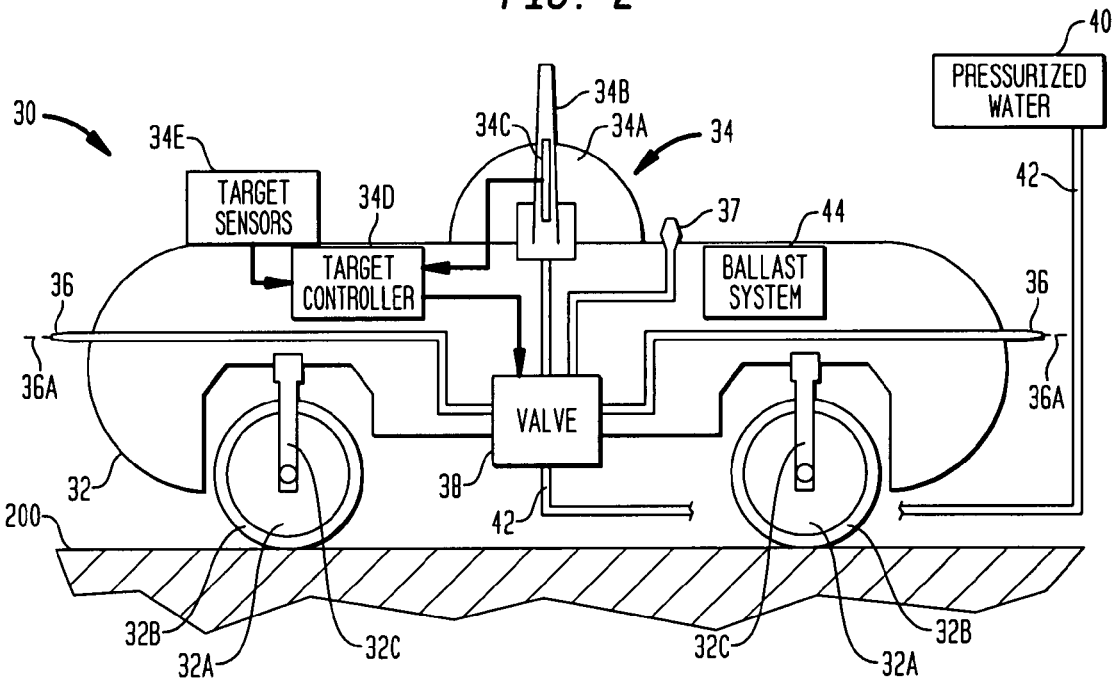
FIG. 2 is a schematic view of an underwater cannon defense system in accordance with an embodiment of the present invention designed to ride along an existing structure's surface.

Vehicle 12 could be a freely-swimming vehicle or one that travels on a "surface" such as the side of a ship, along a port's sea wall, on the sea floor, etc. By way of non-limiting example, one such surface-traveling underwater water cannon defense system is shown in FIG. 2 and is referenced generally by numeral 30. Defense system 30 is designed to roll along a surface 200 underneath the water. Accordingly, defense system 30 includes a rolling vehicle 32 supported on surface 200 by wheels 32A. To accommodate movement along an uneven surface 200, wheels 32A can have (i) rubber (inflated) tires 32B mounted thereon, and (ii) a pneumatic strut or shock absorber 32C for coupling each wheel 32A to vehicle 32. An aimable water cannon assembly 34 includes a rotating/swiveling support base 34A mounted to vehicle 32. Mounted on support base 34A is a water cannon 34B. A targeting sensor 34C can be mounted on water cannon 34B with the output of sensor 34C being supplied to a target controller 34D. Additional target sensors 34E could also be provided on vehicle 32 with the outputs thereof also being supplied to target controller 34D. The target sensor signals would be used by target controller 34D to adjust the position of support base 34A and, therefore, the aim point of water cannon 34B. Target sensors 34E could further include sensors that sense vehicle parameters such as speed, position, etc. The sensed vehicle parameters could form the basis of feedback information supplied to and used by controller 34D to determine the appropriate vehicle speed and/or position. Vehicle speed and/or position can be governed by valve 38 which distributes pressurized water to the vehicle's positioning nozzles as will be described below.

For simplicity, rolling vehicle 32 has two opposingly-directed nozzles 36 mounted thereon such that nozzles 36 can direct pressurized water in opposing directions along a line 36A that is substantially parallel to the portion of surface 200 on which vehicle 32 resides. In this way, rolling vehicle 32 can be shuttled along surface 200 in either of two opposing directions on surface 200. If it is necessary to keep vehicle 32 pressed up against surface 200, one or more additional nozzles 37 connected to valve 38 can be positioned on vehicle 32 to generate the appropriate directional thrust that presses vehicle 32 towards surface 200.

Pressurized water 40 from a remote location (e.g., on the dock, onboard a ship, etc.) can be supplied to water distribution valve 38 via a hose 42. Hose 42 could also be used to carry power and control signal lines (not shown) to vehicle 32. As mentioned above, the pressurized water supply could also be developed onboard vehicle 32 using a pump (not shown) installed on vehicle 32. In either case, valve 38 distributes the pressurized water to (i) nozzles 36/37 to move/position vehicle 32 and (ii) water cannon 34B when shooting the water at a target or targeted region. Distribution valve 38 can be controlled remotely from control signals passed thereto along hose 42. Additionally or alternatively, distribution valve 38 can be controlled by signals generated by target controller 34D.

Vehicle 32 can also be equipped with a ballast system 44 to position and/or maintain vehicle 32 at a desired depth under the water's surface. For example, if vehicle 32 was to be deployed for travel along a sea wall or along the side of a ship, ballast system 44 could positively ballast vehicle 32 to float at a prescribed depth. However, if vehicle 32 was to be deployed on the sea floor, ballast system 44 would negatively ballast vehicle 32 to keep it on the sea floor. Typically, ballast system 44 includes a high-pressure gas reservoir, a ballast tank, intake and exhaust valves, etc. to allow vehicle 32 to achieve a desired depth. Such ballast systems and methods are well understood in the art and are not limitations of the present invention.

Figure 3:
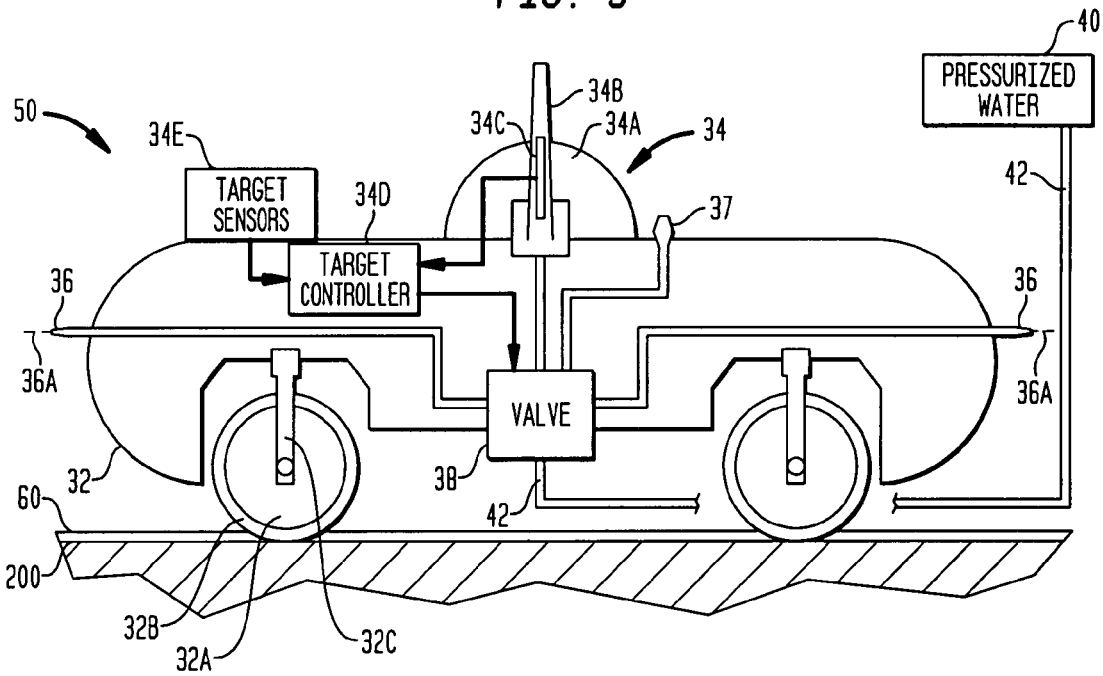
FIG. 3 is a schematic view of an underwater water cannon defense system in accordance with another embodiment of the present invention designed to ride on rails.

The present invention could also be configured to roll along a fixed track as illustrated by defense system 50 in FIG. 3. More specifically, defense system 50 includes a track 60 fixed to surface 200 that guides vehicle 32 therealong when pressurized water is supplied to nozzles 36 so that directional thrust is generated. Note that only opposing nozzles 36 are required to shuttle vehicle 32 in either direction along track 60 if wheels 32 are retained by track 46.

The advantages of the present invention are numerous. The underwater water cannon defense system will provide port facilities and in-port ships or other vessels the means for safe and effective protection against swimmer/diver threats and against threats from small unmanned vehicles. The defense system is easily shuttled to a needed position alongside a port/vessel or on the sea floor. Multiples of the system could be used to deploy a water "barrier" during times of greatest concern of if an underwater threat is expected. The underwater water cannon defense system will have minimal impact on the environment and will be safe to use in and around ports and ships.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

What is claimed as new and desired to be secured by Letters Patent of the United States is:

1. An underwater water cannon defense system, comprising:

a vehicle adapted to be placed underwater;

a water cannon coupled to said vehicle;

at least one nozzle mounted on said vehicle and directed away therefrom;

water distribution means mounted in said vehicle and adapted to receive a supply of pressurized water, said water distribution means distributing selected amounts of the pressurized water to said water cannon and said at least one nozzle wherein movement of said vehicle underwater is governed by said selected amounts distributed to said at least one nozzle; and ballast means mounted on said vehicle for maintaining said vehicle at a selected underwater depth.

2. An underwater water cannon defense system as in claim 1 further comprising wheels coupled to said vehicle wherein said vehicle is adapted to be supported on a surface.

3. An underwater water cannon defense system as in claim 1 further comprising sensing means coupled to said vehicle for detecting at least one of a position of said vehicle and speed of said vehicle during movement thereof.

4. An underwater water cannon defense system as in claim 1 further comprising a movable mount coupled to said vehicle and to said water cannon wherein an aim point of said water cannon is determined by a position of said movable mount.

5. An underwater water cannon defense system as in claim 4 further comprising:

at least one sensor mounted on said vehicle for generating signals indicative of the presence of a target of interest in the water; and aim control means coupled to said sensor and coupled to said movable mount for control thereof, wherein said aim point of said water cannon is controlled by moving said movable mount based on said signals.

6. An underwater water cannon defense system as in claim 1 wherein said at least one nozzle includes first and second nozzles directed in opposing directions.

7. An underwater water cannon defense system, comprising:

a surface vehicle adapted to be positioned on and ride along an underwater structure;

a water cannon coupled to said vehicle;

at least two nozzles mounted on said surface vehicle and directed away therefrom, said at least two nozzles including first and second nozzles directed in opposing directions and along a line that is substantially parallel to a portion of the underwater structure on which said surface vehicle is positioned;

water distribution means mounted in said surface vehicle and adapted to receive a supply of pressurized water, said water distribution means distributing selected amounts of the pressurized water to said water cannon and said at least two nozzles wherein movement of said surface vehicle underwater is governed by said selected amounts distributed to said at least two nozzles; and wheels coupled to said surface vehicle with each of said wheels having an inflatable tire mounted thereon.

8. An underwater water cannon defense system as in claim 7 further comprising ballast means mounted on said surface vehicle for maintaining said surface vehicle at a selected underwater depth.

9. An underwater water cannon defense system as in claim 7 further comprising sensing means coupled to said surface vehicle for detecting at least one of a position of said surface vehicle and speed of said surface vehicle during movement thereof.

10. An underwater water cannon defense system as in claim 7 further comprising a movable mount coupled to said surface vehicle and to said water cannon wherein an aim point of said water cannon is determined by a position of said movable mount.

11. An underwater water cannon defense system as in claim 10 further comprising:

at least one sensor mounted on said surface vehicle for generating signals indicative of the presence of a target of interest in the water; and aim control means coupled to said sensor and coupled to said movable mount for control thereof, wherein said aim point of said water cannon is controlled by moving said movable mount based on said signals.

12. An underwater water cannon defense system as in claim 7 further comprising a third nozzle adapted to be directed substantially away from the portion of the underwater structure on which said surface vehicle is positioned.

13. An underwater water cannon defense system, comprising:

a vehicle adapted to be placed underwater;

a water cannon coupled to said vehicle;

a movable mount coupled to said vehicle and to said water cannon wherein an aim point of said water cannon is determined by a position of said movable mount;

at least one nozzle mounted on said vehicle and directed away therefrom;

water distribution means mounted in said vehicle and adapted to receive a supply of pressurized water, said water distribution means distributing selected amounts of the pressurized water to said water cannon and said at least one nozzle wherein movement of said vehicle underwater is governed by said selected amounts distributed to said at least one nozzle; and ballast means mounted on said vehicle for maintaining said vehicle at a selected underwater depth.

14. An underwater water cannon defense system as in claim 13 further comprising wheels coupled to said vehicle wherein said vehicle is adapted to be supported on a surface.

15. An underwater water cannon defense system as in claim 13 further comprising sensing means coupled to said vehicle for detecting at least one of a position of said vehicle and speed of said vehicle during movement thereof.

16. An underwater water cannon defense system as in claim 13 further comprising:

at least one sensor mounted on said vehicle for generating signals indicative of the presence of a target of interest in the water; and aim control means coupled to said sensor and coupled to said movable mount for control thereof, wherein said aim point of said water cannon is controlled by moving said movable mount based on said signals.

17. An underwater water cannon defense system as in claim 13 wherein said at least one nozzle includes first and second nozzles directed in opposing directions.

* * * * *